US006027386A

United States Patent [19]

Hains et al.

[11] Patent Number: 6,027,386

[45] Date of Patent: Feb. 22, 2000

[54] COMBINATION PADDLE AND WATER SYRINGE

[76] Inventors: Nancy Hains; Kenneth J Savory, both of 1016 Magnolia Dr., Healdsburg, Calif. 95448

[21] Appl. No.: 09/099,259

[22] Filed: Jun. 17, 1998

[51] Int. Cl.[7] ..... B63H 16/04

[52] U.S. Cl. ..... 440/101; 114/221 R

[58] Field of Search ..... 441/91; 440/101; 152/415; D23/231; 417/566; 114/221 R

[56] References Cited

U.S. PATENT DOCUMENTS

| | | | |
|---|---|---|---|
| 1,078,320 | 11/1913 | Stratton | D23/231 |
| 4,820,216 | 4/1989 | Masters | 440/101 |
| 4,911,364 | 3/1990 | Irie . | |
| 5,016,669 | 5/1991 | Jamieson | 417/566 |
| 5,163,778 | 11/1992 | Botero | 440/101 |
| 5,231,951 | 8/1993 | Tagar . | |
| 5,322,462 | 6/1994 | Hull et al. | 440/101 |
| 5,902,162 | 5/1999 | Kot et al. | 440/101 |

*Primary Examiner*—Stephen Avila
*Attorney, Agent, or Firm*—Larry D. Johnson

[57] ABSTRACT

A hand operated boat propulsion device (paddle or oar) that may also be used to draw and spray water. The device may also be used as an air pump.

1 Claim, 4 Drawing Sheets

COMBINATION PADDLE AND WATER SYRINGE

BACKGROUND OF THE INVENTION

1. Field of the Invention

This invention relates to small boat propulsion and water syringes, specifically to hand held paddles and oars.

2. Description of Prior Art

Hand held paddles and oars for propelling small boats are well known as are syringe devices and hand air pumps. The syringe devices are usually used for shooting a jet of water after the water has been drawn into the device.

OBJECTS AND ADVANTAGES

Many times it is desirable to carry both a paddle and syringe device in a boat. The syringe device may be used to bail water from the boat or more likely as water gun as fun way to cool down on a hot summer day. A boat may become too cluttered if there are several people on a single boat who each have a paddle and a water syringe. It would be especially difficult for a person to keep track of both a water syringe and a paddle on a white water raft. The object of the present invention is to combine the paddle and water syringe into one convenient device. The present invention also may be configured as an air pump. The paddle can be used to propel a boat, to draw and spray water, and to inflate an inflatable raft or boat.

Figure 1:
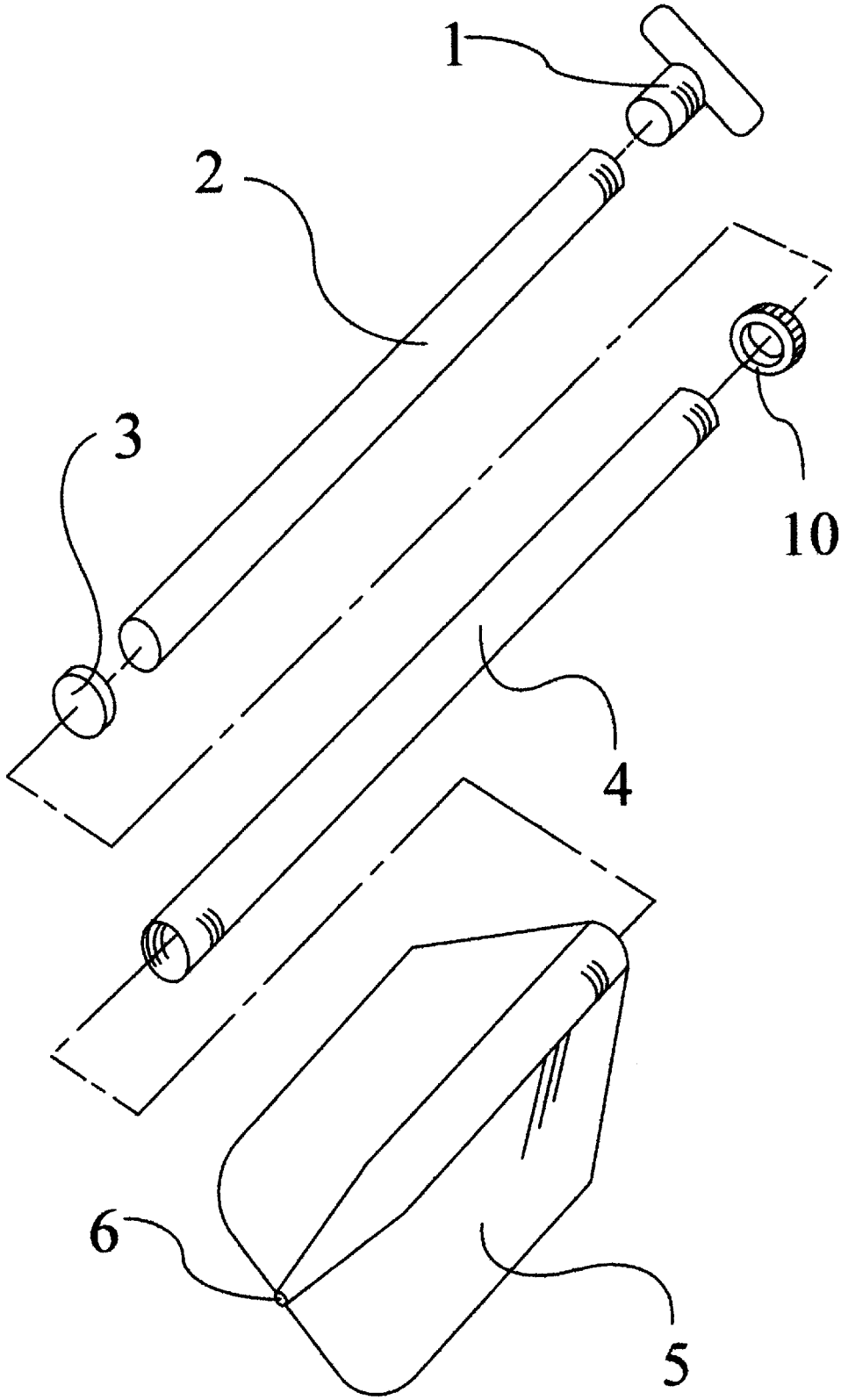
FIG. 1 is an exploded view of the present invention.

| List of Reference Numerals |
|---|
| 1. Handle |
| 2. Plunger |
| 3. Seal |
| 4. Shaft |
| 5. Paddle blade |
| 5a. Blade half |
| 5b. Second blade |
| 6. Nozzle |
| 7. Port |
| 8. Inlet valve |
| 9. Outlet valve |
| 10. Lock |

DESCRIPTION

FIG. 1

A typical configuration of the present invention is shown in FIG. 1. An optional handle 1 is attached to one end or top of a shaft, rod, or plunger 2. A gasket, diaphragm, or seal 3 is attached to the opposite end or bottom of plunger 2. The assembly of plunger 2 is inserted into one end or top end of a handle, rod, or shaft 4. Seal 3 is sized such that it provides an air tight fit in shaft 4. The assembly of plunger 2 can be slid up and down inside shaft 4 by hand. A paddle or blade

5 is attached to opposite or the bottom end of shaft 4. An orifice, port or nozzle 6 is located at the lower end of blade 5. An optional clamp or lock 10 may be installed on shaft 4.

FIG. 2

Figure 2:
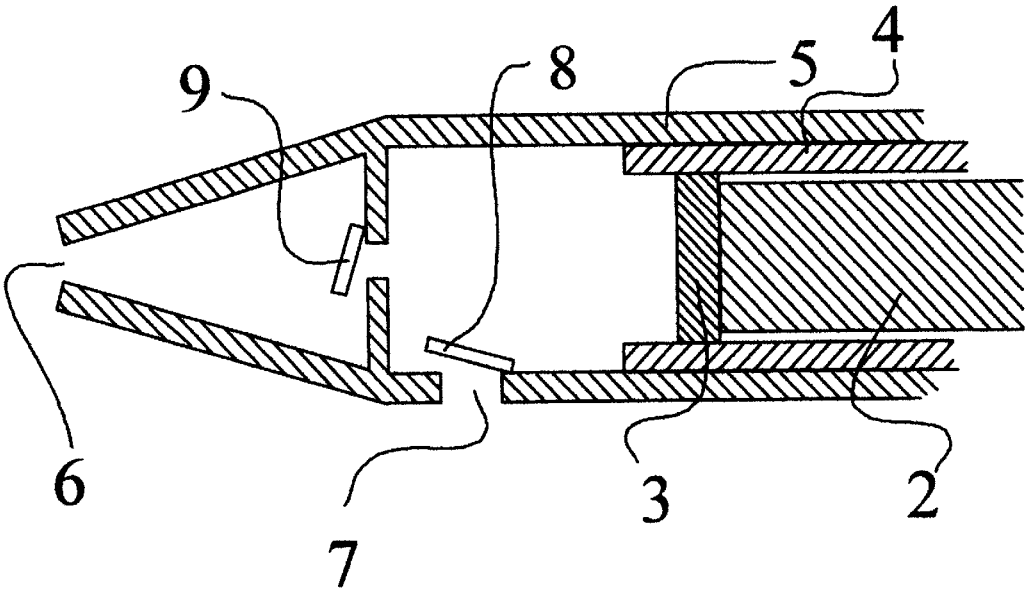
FIG. 2 is a paddle or an oar configured to pump air.

FIG. 2 shows blade 5 with an optional second nozzle, orifice or port 7. Blade 5 also has an optional diaphragm or check valve 8 that allows fluid to enter but not exit through port 7. An optional diaphragm or check valve 9 allows fluid to exit but not enter through nozzle 6. The configuration of valve 8 and valve 9 as shown is only one of many possible configurations; check valves are well known in industry and can be constructed in various ways.

FIG. 3

Figure 3:
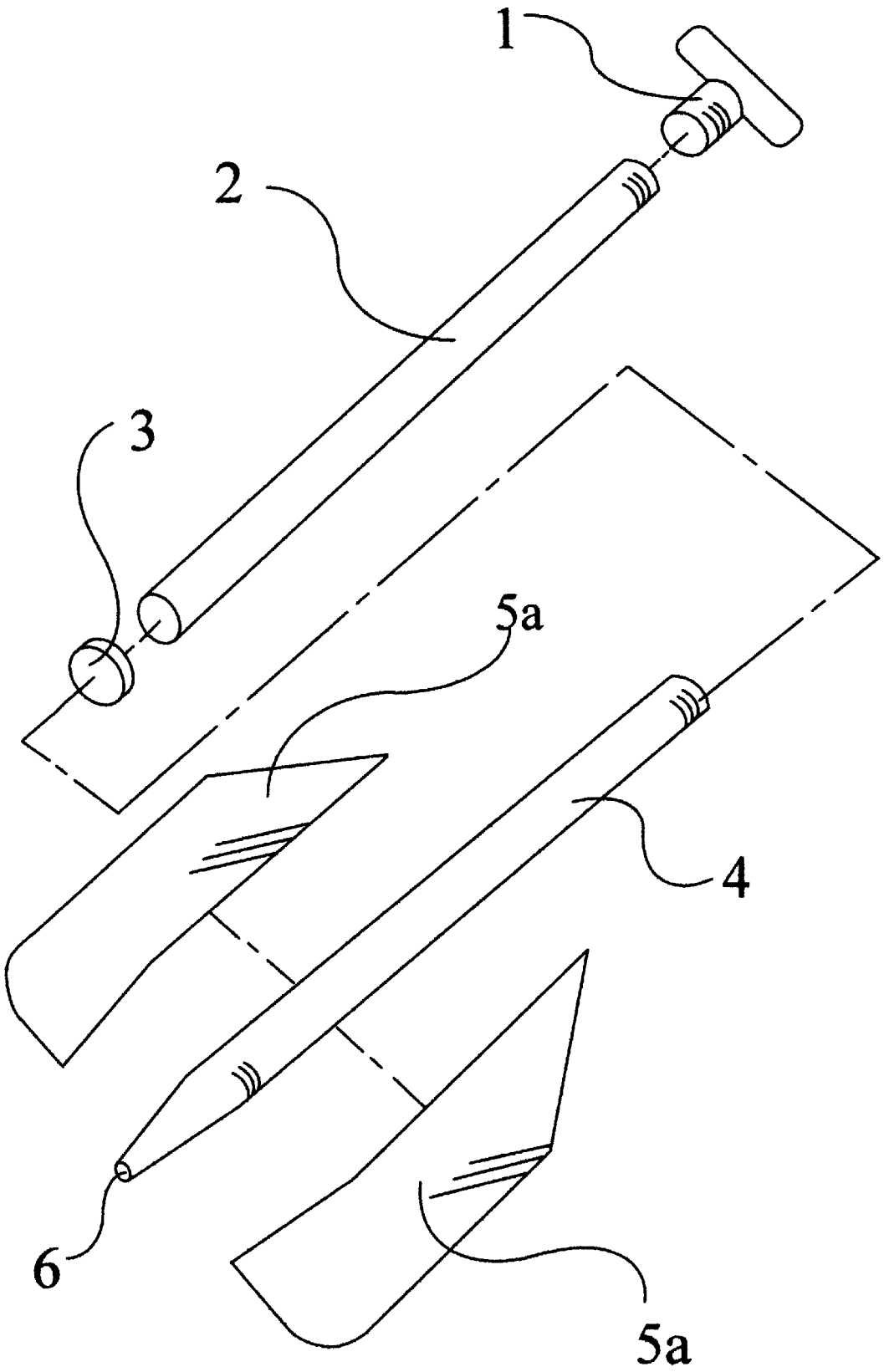
FIG. 3 is an exploded view of a construction alternative of the present invention.

An alternative construction for the present invention is shown in FIG. 3. Handle 1, plunger 2, and seal 3 are connected together as in FIG. 1. Blade halves 5*a* are connected to the bottom end of shaft 4. Nozzle 6 is located in the bottom end of shaft 4.

FIG. 4

Figure 4:
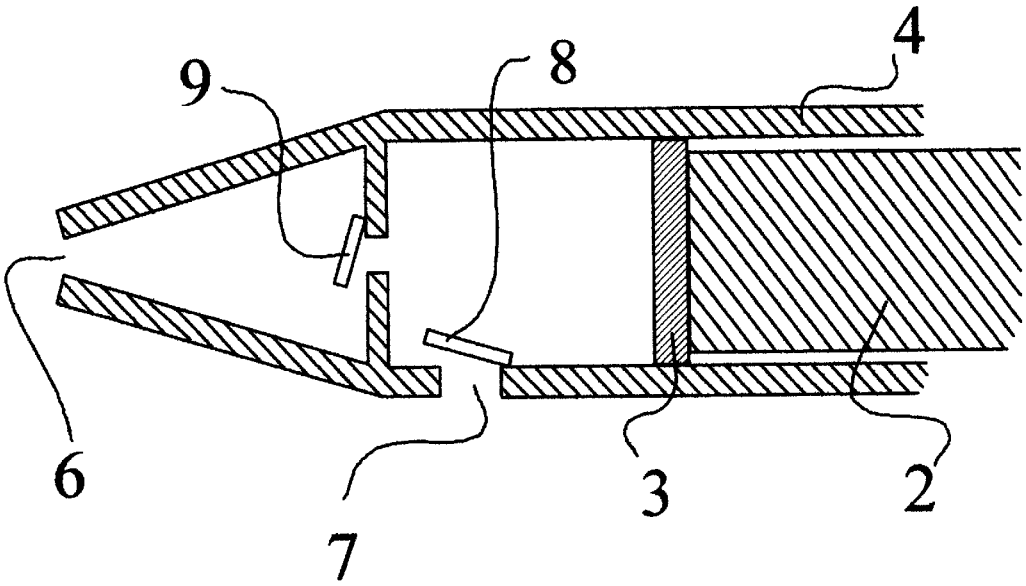
FIG. 4 is the construction alternative configured to pump air.

FIG. 4 shows port 7, check valve 8, and check valve 9 mounted in shaft 4 instead of blade 5 of FIG. 2.

FIG. 5

Figure 5:
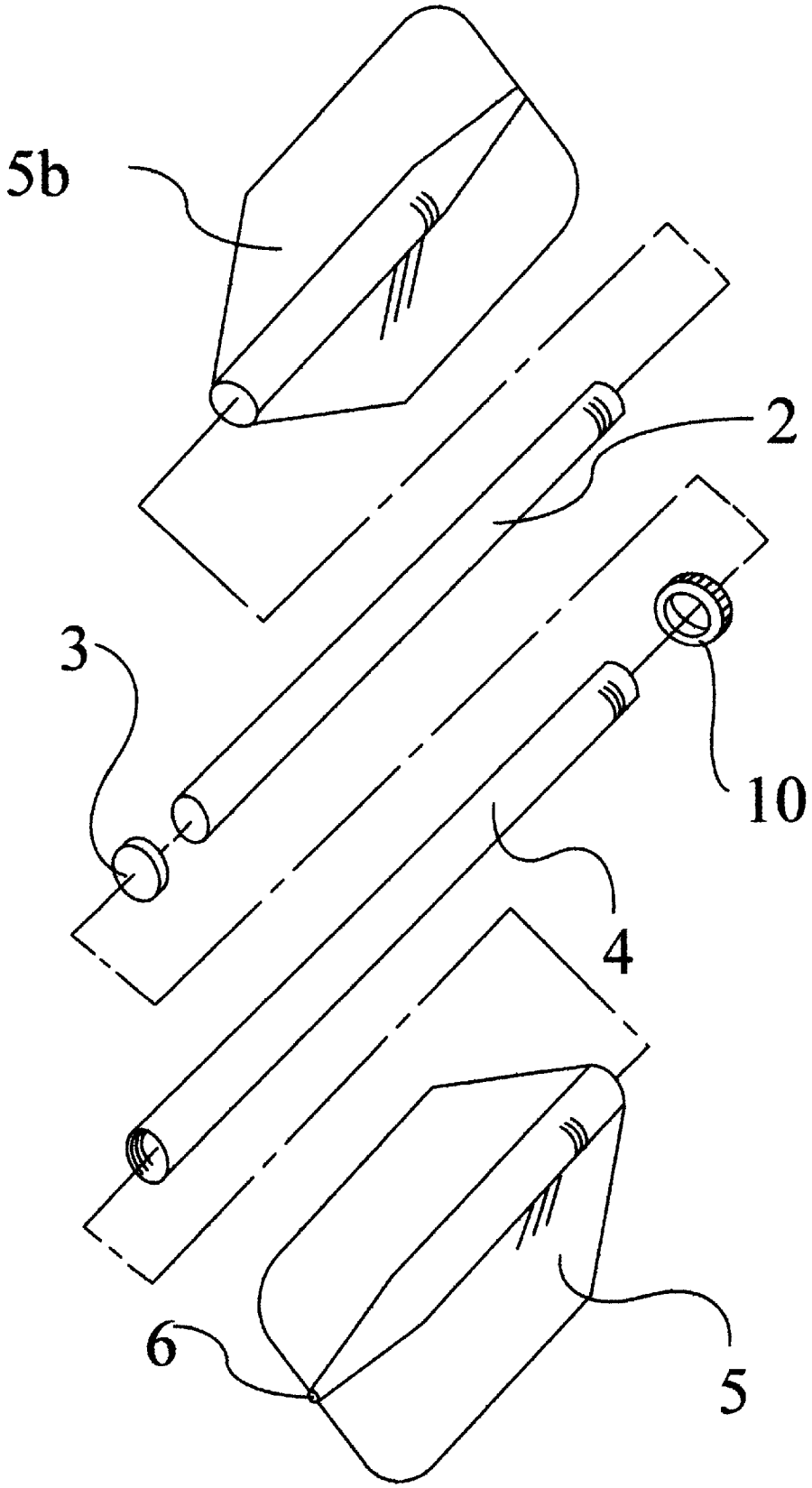
FIG. 5 is an exploded view of an alternative configuration of the present invention.

FIG. 5 is an exploded view of the present invention configured for kayak use. Handle 1 of FIG. 1 is replaced by a second blade 5*b*.

OPERATION

FIG. 1

When the assembly of plunger 2 is retracted all the way into shaft 4, the present invention may be used as a standard hand held water paddle. When extracting the assembly of plunger 2 while immersing nozzle 6 in a fluid, the fluid is drawn into shaft 4 through nozzle 6. When the assembly of plunger 2 is pushed into or retracted into shaft 4 the fluid is forced out of nozzle 6. Plunger 2 may be locked into a fixed position with shaft 4 using optional lock 10.

FIG. 2

With port 7 and valve 8 installed in blade 5, the assembly may be used as an air pump as well as a water syringe. Valve 9 acts to stop a fluid from entering nozzle 6 while valve 8 allows it to enter through port 7. When plunger 2 of FIG. 1 is depressed valve 9 will allow a fluid to exit nozzle 6, but valve 8 will prevent the fluid from exiting port 7. It is possible to combine valve 8 and valve 9 into a single valve.

FIG. 3

The assembly of FIG. 3 operates the same as the assembly of FIG. 1; only the construction is different.

FIG. 4

The assembly of FIG. 4 operates the same as the assembly of FIG. 2; the assembly is mounted in shaft 4 instead of blade 5.

FIG. 5

The assembly of FIG. 5 operates the same as the assembly of FIG. 1; it is configured for kayak or canoe use.

SUMMARY, RAMIFICATIONS, AND SCOPE

The reader can see the advantages of a paddle or an oar that also may be used as a syringe, sprayer, and air pump. When using the present invention a boater does not to need to carry a bailing device. It can also eliminate the need to carry an air pump in an inflatable boat or inflatable raft. The present invention also may be used as a toy for spraying other people with water. When an inflatable raft or boat is in the sun the air inside may heat up an expand causing damage to the boat. Inflatable rafts are usually cooled by splashing water on them; the present invention can be used to spray water onto the raft.

It is possible to make the assembly of plunger 2 in one piece with such a fit that seal 3 is not needed. Plunger 2 does not require a handle if plunger 2 is constructed such that it is long enough to allow a person to grip it when it is completely retracted.

The addition of a plunger to a standard paddle does not limit the style of the paddle. Blade 5 can be constructed in any shape or size to provide the best performance for its intended application. The style of handle 1 also may vary depending on the intended application.

The assembly of FIG. 4 may include a passage in seal 3 whereby water may enter plunger 2. A nozzle may be added to blade 5*b* allowing fluid to be sprayed through both blades. A valve may be used to prevent air from entering through the nozzle in blade 5*b* while liquid is drawn in through nozzle 6.

The paddle may be constructed such that it only operates as an air pump. Seal 3 can be may to allow air to pass while plunger 2 is extended so that it operates the same as a standard bicycle pump.

An adapter can be made to operate with the present invention. The valves may be incorporated into the adapter instead of the paddle. The adapter may include a hose making it easier to attach to the device to be filled with air.

Thus the figures and descriptions show a possible configuration and use of the present invention, but do not limit the scope of the present invention.

We claim:

1. A combination paddle and water syringe apparatus comprising:

a paddle portion having an upper end and a lower end, a hollow chamber having an exterior surface and openings at the upper and lower ends of said paddle portion, two blades integrally connected to the exterior surface of said hollow chamber in an opposing relationship such that said blades lie in the same planes an inlet port for the inflow of water or air into the interior of said hollow chamber, and an outlet port for the expulsion of water or air from the interior of said hollow chamber;

a first check valve pivotally connected to said inlet port for controlling the inflow of water or air into said hollow chamber of said paddle portion;

a second check valve pivotally connected to said outlet port for controlling the outflow of water or air into said hollow chamber of said paddle portion;

a hollow cylindrical shaft having upper and lower ends and openings at each of said upper and lower ends and coupled to said paddle portion at the opening at the upper end of said hollow chamber;

a plunger having upper and lower ends and slidably coupled to the interior wall of said hollow cylindrical shaft such that said plunger moves longitudinally relative to said hollow cylindrical shaft for substantially the entire length of said hollow cylindrical shaft;

a cylindrical seal affixed to the lower end of said plunger forming tight seal between the interior hollow cylindrical shaft wall and the outer circumferential edge of said seal; and a second paddle portion attached to the upper end of said plunger, said second paddle portion including two blades integrally connected to the exterior surface of a hollow chamber.

* * * * *